US010421593B1

(12) United States Patent
Litten

(10) Patent No.: US 10,421,593 B1
(45) Date of Patent: Sep. 24, 2019

(54) CAP TETHER ACCESSORY FOR DRINKING BOTTLE

(71) Applicant: Susan Taslimi Litten, Parkland, FL (US)

(72) Inventor: Susan Taslimi Litten, Parkland, FL (US)

( * ) Notice: Subject to any disclaimer, the term of this patent is extended or adjusted under 35 U.S.C. 154(b) by 0 days.

(21) Appl. No.: 15/863,089

(22) Filed: Jan. 5, 2018

(51) Int. Cl.
*B65D 55/16* (2006.01)

(52) U.S. Cl.
CPC ..... *B65D 55/16* (2013.01)

(58) Field of Classification Search
CPC ..... B65D 55/16
USPC ..... 215/306, 386; 220/375, 735; D9/719, D9/739, 517, 455, 446
See application file for complete search history.

(56) References Cited

U.S. PATENT DOCUMENTS

| | | | | |
|---|---|---|---|---|
| 591,668 | A | 10/1897 | Johnson | |
| 715,399 | A | 12/1902 | Low | |
| 798,775 | A | 9/1905 | Forsyth | |
| 1,836,811 | A | 9/1928 | McNeal | |
| 1,924,242 | A | 8/1933 | Kaye | |
| 2,978,134 | A * | 4/1961 | Caine | A45F 3/16 215/306 |
| 3,209,963 | A | 10/1965 | Krieps | |
| 4,753,358 | A * | 6/1988 | Virca | B01L 3/50825 215/230 |
| 5,653,353 | A | 8/1997 | Otto | |
| 6,302,286 | B1 * | 10/2001 | Witherspoon | A61J 11/008 215/11.1 |
| D628,088 | S * | 11/2010 | Huntington | D9/719 |
| 8,245,870 | B2 | 8/2012 | McKinney | |
| 8,371,244 | B2 | 2/2013 | Krasner | |
| 8,752,720 | B1 * | 6/2014 | Habig | B65D 55/16 215/306 |
| D762,117 | S * | 7/2016 | Joseph | D7/387 |
| 2005/0247714 | A1 | 11/2005 | Backes | |
| 2009/0236341 | A1 * | 9/2009 | McKinney | A47G 19/2266 220/375 |

* cited by examiner

*Primary Examiner* — Robert J Hicks
(74) *Attorney, Agent, or Firm* — Mark D. Bowen; Malin Haley DiMaggio & Bowen, P.A.

(57) ABSTRACT

A drinking bottle accessory in comprises a cap holder and tether adapted for removable attachment to a drinking bottle wherein first and second resilient annular members are connected in spaced relation by a support member disposed therebetween. The first annular ring is adapted to attach to the neck of a drinking bottle, and the second annular ring is adapted to receive the cap of the drinking bottle upon removal. The resilient nature of the material forming the first and second annular rings enables the accessory to be used with drinking bottles of a variety of shapes and sizes. The support member connecting the first and second annular rings is preferably rigid or semi-rigid to maintain the cap in position thereby preventing the cap from interfering with the act of drinking.

3 Claims, 7 Drawing Sheets

CAP TETHER ACCESSORY FOR DRINKING BOTTLE

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to drinking bottles, and more particularly to a tether accessory for removably securing the drinking bottle cap to the bottle.

2. Description of Related Art

Staying hydrated is important to a person's overall good health. It helps maintain one's temperature, remove waste from the body, and lubricate the joints. In recognition of these benefits, in recent years people have increased their consumption of fluids, particularly water. Initially, consumers demonstrated a preference for consuming water sold in disposable plastic bottles. Recently, however, the chemical composition of disposable plastic bottles, particularly those containing Biphenol (commonly known as BPA), have been linked to health hazards. As a result, consumer preference has shifted to the use of reusable drinking containers. Many reusable drinking containers are formed with insulated bodies having removable caps.

A significant problem existing with the use of drinking bottles having removable cabs involves retaining the cap upon removal such that it is not misplaced or lost. A number of attempts to provide means for securing drinking bottle caps are found in the background art. U.S. Pat. No. 8,245,870, issued to McKinney, discloses a container cap with tether which functions to keep the cap secured adjacent to the container when removed as illustrated below. The tether is looped unto itself permitting the spout cover and a portion of the tether to be extended to reach the top opening and to be retracted withdrawing the spout cover to a position remote from the drinking spout. U.S. Pat. No. 8,371,244, issued to Krasner, discloses a water bottle having a removable screw cap secured to the bottle by a tether attached to rigid tether rings.

The prior art devices are burdened by a number of limitations and disadvantages that have limited widespread commercial acceptance and use. One problem with the prior art devices is that they are fully integrated into the drinking bottle and/or cap and thus limited in use to a single bottle. Another problem with the prior art devices is that many of them retain the cap on a flexible tether whereby the cap dangles loosely from the drinking bottle such that the cap can strike the user in the face as the drinking container is tilted when the user sips the contents. Accordingly, there exists a need in the art for an improved drinking bottle accessory for use with a variety of drinking containers to removably secure the container cap.

BRIEF SUMMARY OF THE INVENTION

The present invention overcomes the limitations and disadvantages present in the art by providing an accessory for use with drinking bottles to removably secure the cap. In accordance with a preferred embodiment, a drinking bottle accessory in accordance with the present invention comprises a cap holder and tether adapted for removable attachment to a drinking bottle. The device includes first and second annular members connected in spaced relation by a support member disposed therebetween. Both the first and second annular members preferably comprise cylindrically-shaped rings formed of resilient material. The first annular ring is adapted to attach to the neck of a drinking bottle, and the second annular ring is adapted to receive the cap of the drinking bottle upon removal. The resilient nature of the material forming the first and second annular rings enables the accessory to be used with drinking bottles of a variety of shapes and sizes. The support member connecting the first and second annular rings is to preferably rigid or semi-rigid to maintain the cap in position thereby preventing the cap from interfering with the act of drinking.

Accordingly, it is an object of the present invention to provide a cap retaining accessory for use with drinking bottles.

Another object of the present invention is to provide a cap retaining accessory that maintains the cap in a predetermined position while the drinking bottle is inverted for drinking.

In accordance with these and other objects, which will become apparent hereinafter, the instant invention will now be described with particular reference to the accompanying drawings.

DETAILED DESCRIPTION OF THE INVENTION

Figure 1:
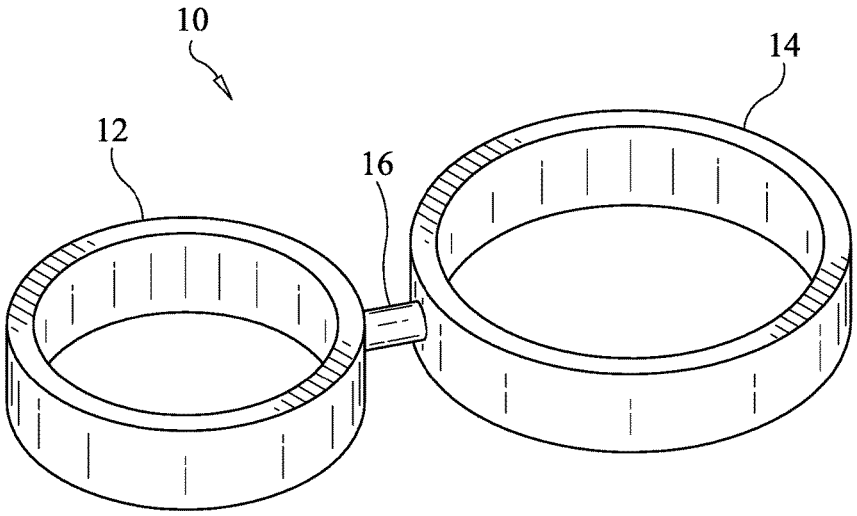
FIG. 1 is a top perspective view of a drinking bottle accessory in accordance with the present invention.
Figure 2:
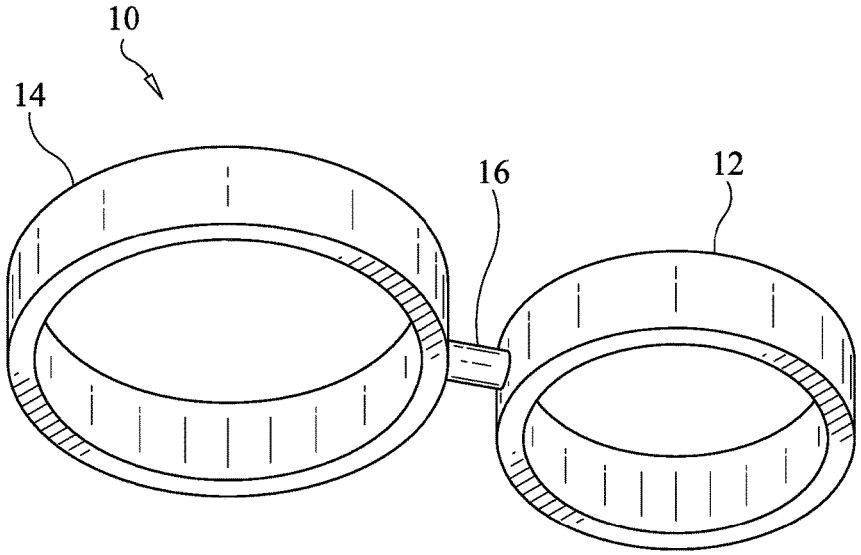
FIG. 2 is a bottom perspective view thereof.
Figure 3:
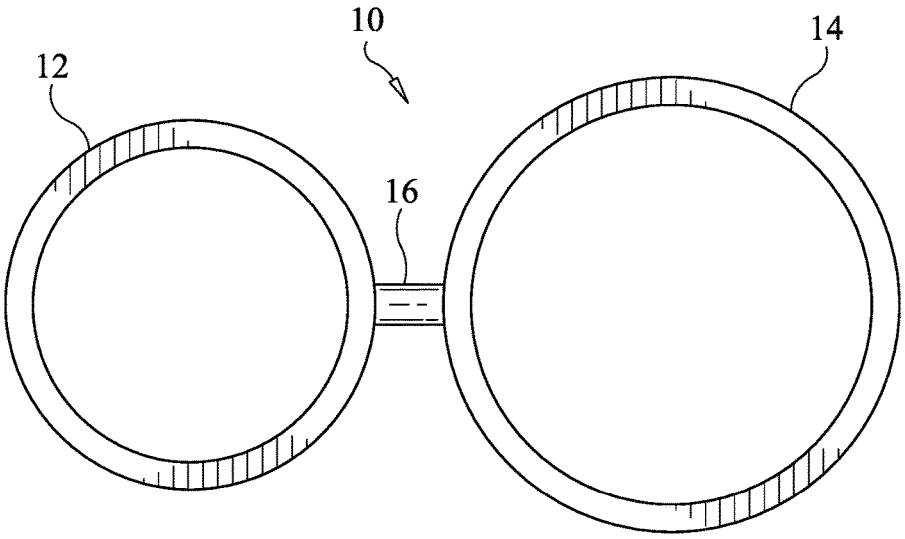
FIG. 3 is a top view thereof, with the bottom view being a mirror image.
Figure 4:
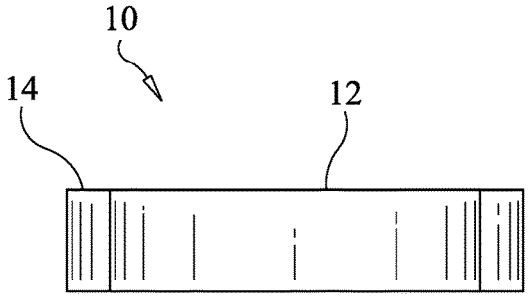
FIG. 4 is a front view thereof.
Figure 5:
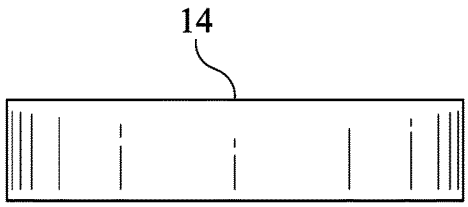
FIG. 5 is a rear view thereof.
Figure 6:
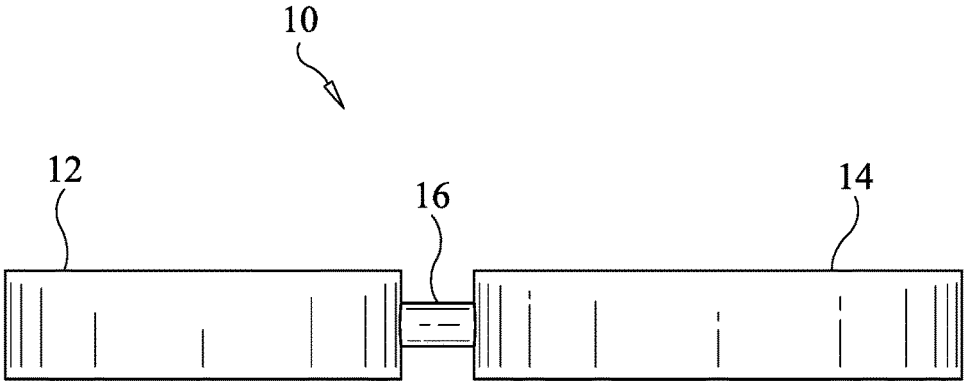
FIG. 6 is a left side view thereof.
Figure 7:
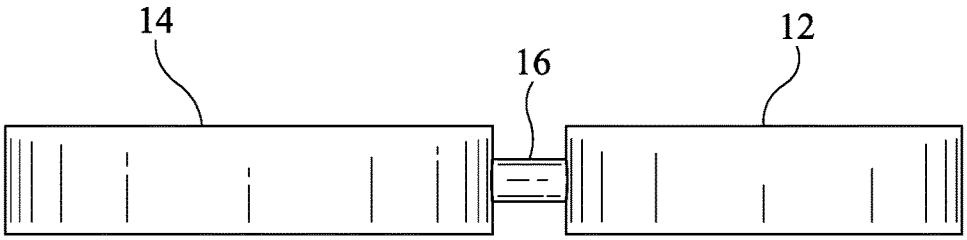
FIG. 7 is a right side view thereof.
Figure 8:
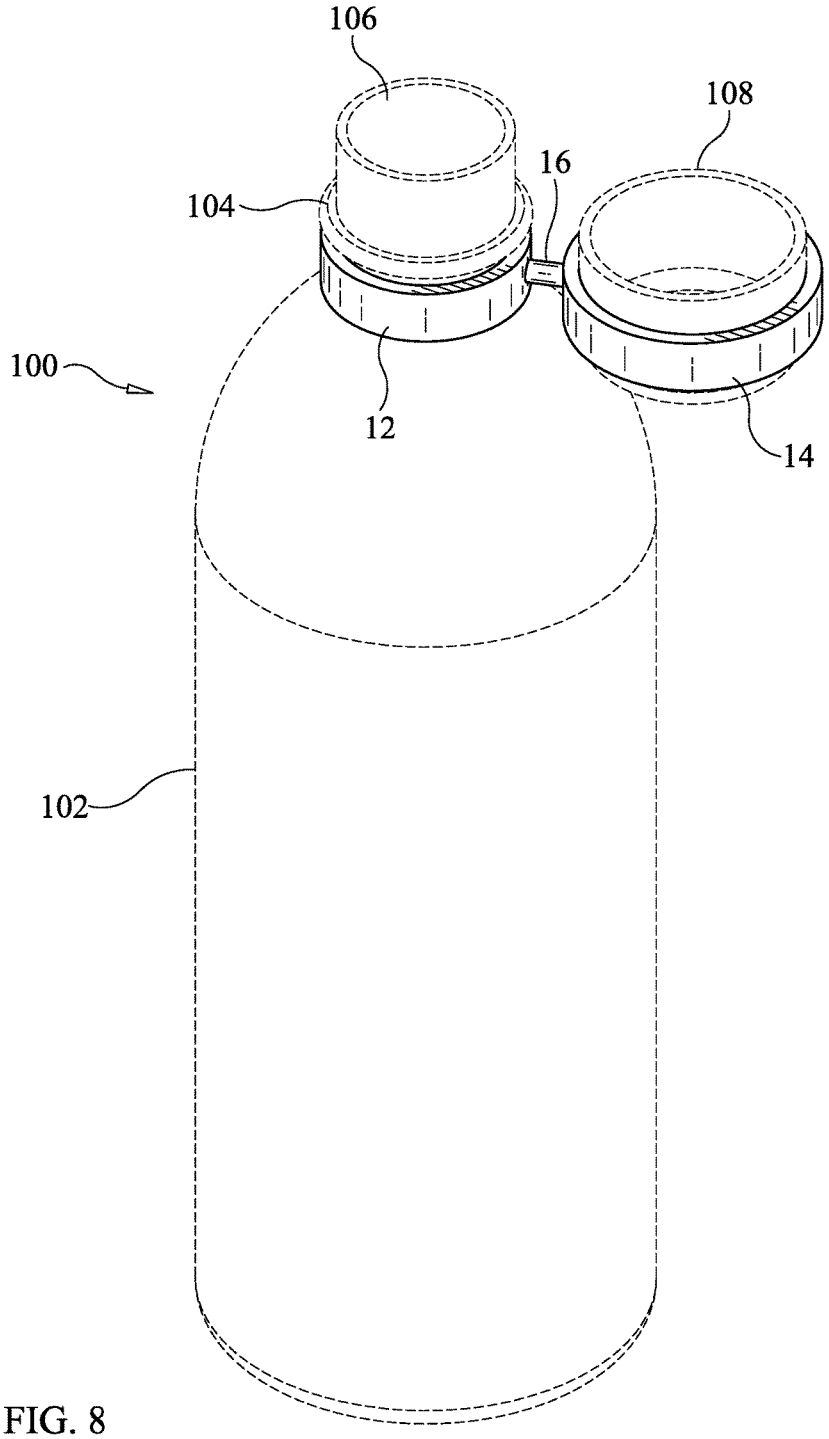
FIG. 8 is a perspective view of the drinking bottle accessory attached to a drinking bottle while retaining a detached cap.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within the ranges as if each numerical value and sub-range is explicitly recited. As an illustration, a numerical range of "about 1 to 5" should be interpreted to include not only the explicitly recited values of about 1 to about 5, but also include individual values such as 2, 3, and 4 and sub-ranges such as from 1-3, from 2-4, and from 3-5, etc. as well as 1, 2, 3, 4, and 5, individually. The same principle applies to ranges reciting only one numerical value as a minimum or maximum. Furthermore, such an interpretation should apply regardless of the breadth of the range or the characteristics being described.

FIGS. 1-11 depict a drinking bottle accessory, generally referenced as 10, in accordance with the present invention. Drinking bottle accessory 10 comprises a cap holder and tether adapted for removable attachment to a drinking bottle for retaining the cap while the user drinks. As best seen in FIGS. 1-7, drinking bottle accessory 10 includes first and second annular members, referenced as 12 and 14 respectively. First and second annular members 12 and 14 are connected in spaced relation by a support member 16 disposed therebetween. The term support member shall be broadly construed to mean a rigid or semi-rigid structure capable of maintaining and supporting the second annular member in cantilevered fashion when the cap is installed. Annular members 12 and 14, and support member 16, are preferably integrally formed as a one-piece unit, however, any suitable form is considered within the scope of the present invention.

Figure 9:
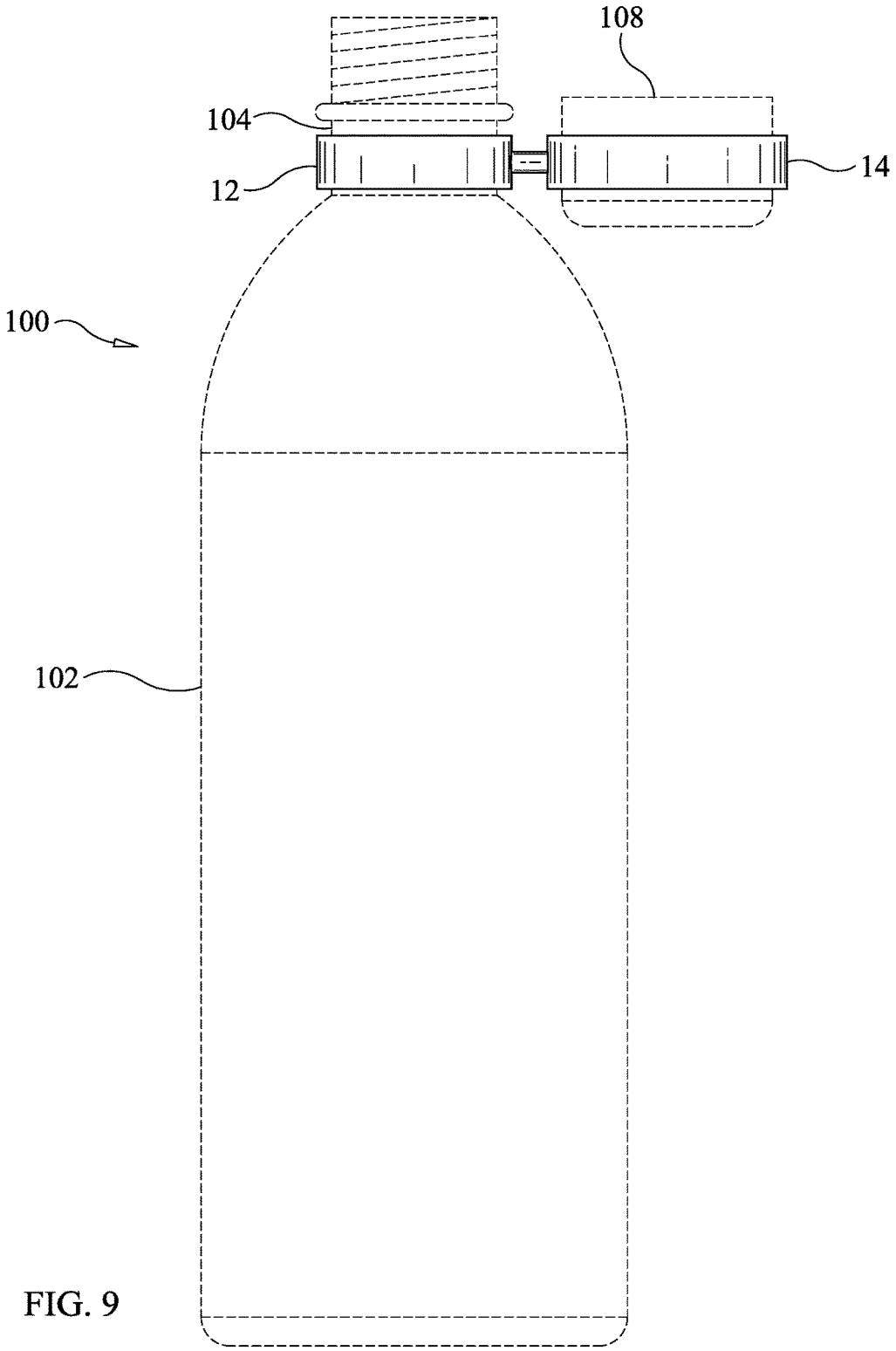
FIG. 9 is a side view thereof.
Figure 10:
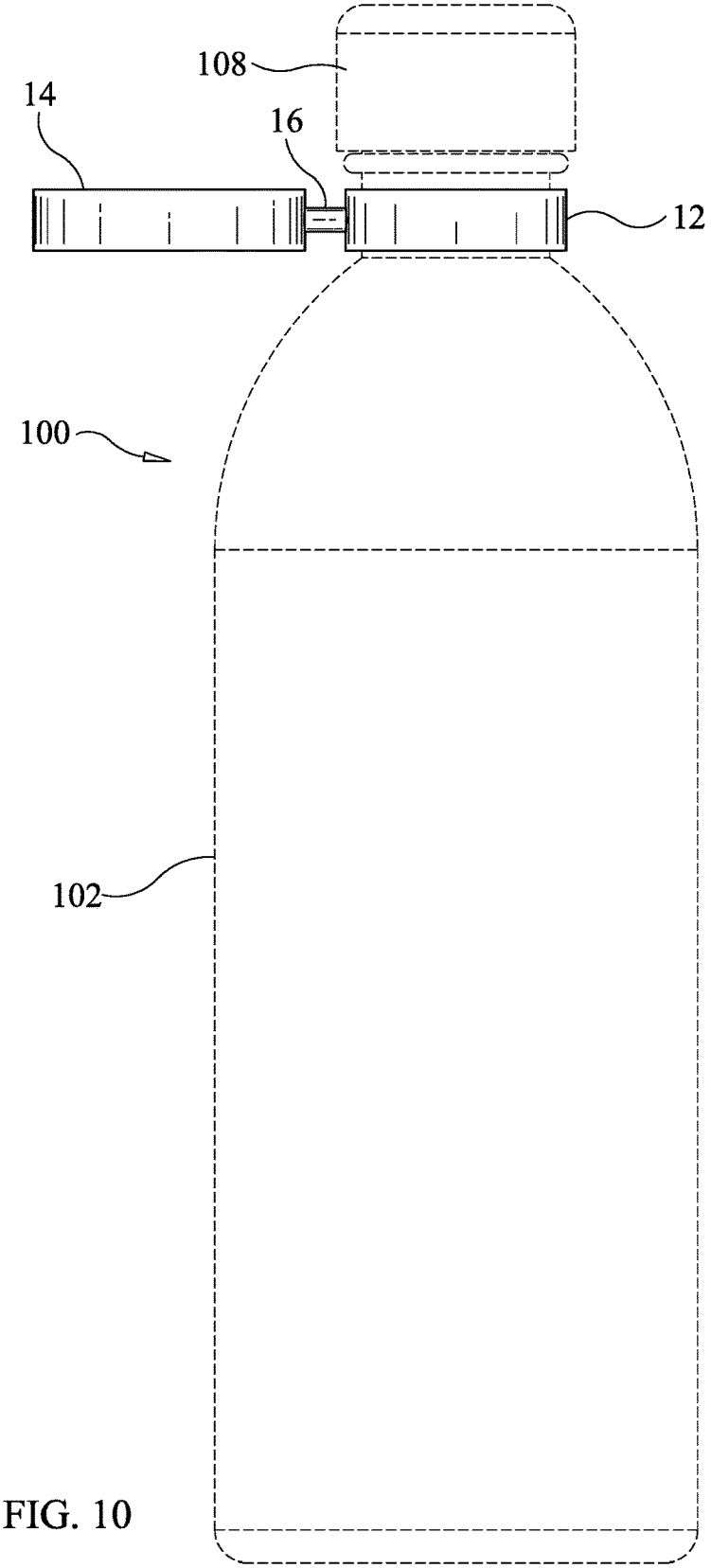
FIG. 10 is a side view of the drinking bottle accessory attached to a drinking bottle with the cap affixed to the bottle.
Figure 11:
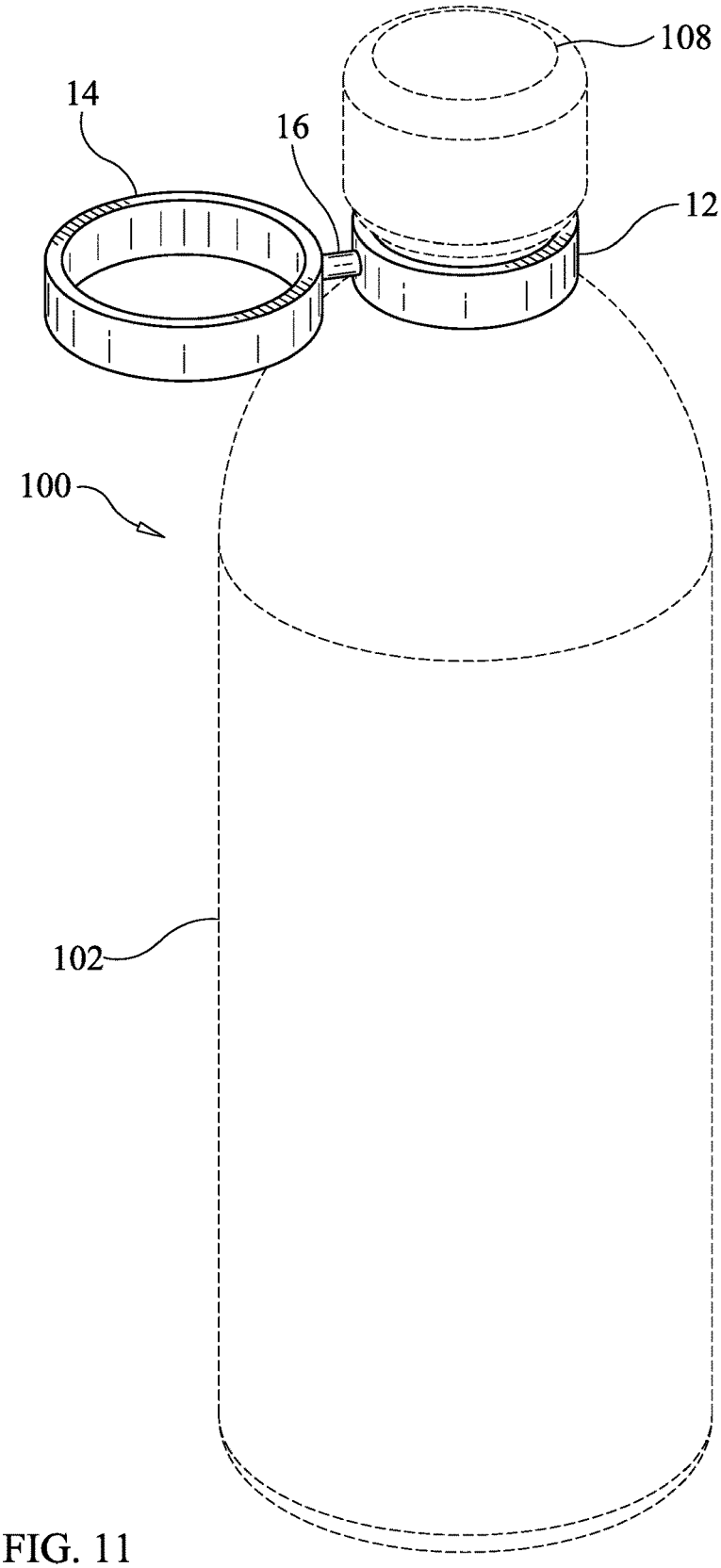
FIG. 11 is a perspective view thereof.

Both the first and second annular members, 12 and 14, preferably comprise cylindrically-shaped rings formed of resilient material. As illustrated in FIGS. 9-11, first annular ring 12 is adapted to attach to the neck of a drinking bottle, and the second annular ring 14 is adapted to receive the cap of the drinking bottle upon removal. The resilient nature of the material forming the first and second annular rings enables elastic radial deformation whereby the accessory to be used with drinking bottles of a variety of shapes and sizes. In a preferred embodiment, the first annular ring 12 has a diameter that is approximately 5%-15% less than the diameter of the neck of the drinking bottle so as to form a compression fit. Similarly, the second annular ring 14 has a diameter that is approximately 5%—10% less than the diameter of the cap of the drinking bottle so as to form a compression fit. A significant aspect of the present invention involves providing support member 16 which connects the first and second annular rings, 12 and 14, wherein the support member is characterized as being sufficiently stiff to maintain the cap in position thereby preventing the cap from interfering with the act of drinking. Accordingly, support member 16 may be fabricated from the same resilient material that forms annular rings 12 and 14, or in the alternative may be formed of a different semi-rigid or rigid material having a stiffness sufficient to maintain ring 14 (with the cap disposed therein) supported in a generally cantilevered configuration.

Drinking bottle accessory 10 differs from drinking bottle cap tether accessories of the background art in that annular ring 14 is not affixed to the drinking bottle cap when the cap is installed on the drinking bottle in the closed configuration. Accordingly, when in use the user removes the cap from the drinking bottle and inserts it into the second annular ring 14. Once inserted therein, the cap is maintained in spaced relation with the bottle as the user drinks, and more particularly, support member 16 prevents the cap form flopping downward.

FIGS. 8-11 illustrate drinking bottle accessory 10 affixed in operative relation with a drinking bottle, referenced as 100. Drinking bottle 100 includes a main body 102, having an upper portion defining a neck 104 forming an opening 106. A cap 108 is configured for removable attachment to the neck, in covering relation with opening 106 thereby forming a watertight seal. A significant aspect of the present invention relates to providing first and second resilient rings that allow for removable installation of the first annular ring 12 on the neck of a drinking bottle, as well as removable insertion of the cap within the second annular ring 14.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A cap tether for use with a drinking bottle having a neck upwardly terminating at an opening, and a cap removably affixed at said opening, said cap tether comprising:

a first annular member sized for receiving the drinking bottle neck therein;

a second annular member sized for receiving the drinking bottle cap therein only when the cap is removed from the drinking bottle; and a rigid support member disposed between said first and second annular members, said support member supporting said second annular member in cantilevered relation with said first annular member when the drinking bottle cap is removed from the drinking bottle and disposed therein.

2. The cap tether according to claim 1 wherein said first and second annular members are formed of resilient material.

3. A cap holder accessory for a drinking bottle having a neck terminating at an opening and a cap removably attached to the neck, said cap holder accessory comprising:

a resilient first annular member sized for receiving the drinking bottle neck therein in compression fit;

a resilient second annular member sized for receiving the drinking bottle cap therein only when removed from the drinking bottle in compression fit; and a support member, rigid along its entire length, connecting said first and second annular members and maintaining said second annular member in cantilevered relation with said first annular member with the drinking bottle cap is separated from the bottle and disposed therein.

* * * * *